US008702281B2

(12) United States Patent
Okada et al.

(10) Patent No.: US 8,702,281 B2
(45) Date of Patent: Apr. 22, 2014

(54) LIGHTING FIXTURE UNIT

(75) Inventors: Hidetaka Okada, Kawaguchi (JP); Takuya Matsumaru, Yokohama (JP)

(73) Assignee: Stanley Electric Co., Ltd., Tokyo (JP)

( * ) Notice: Subject to any disclaimer, the term of this patent is extended or adjusted under 35 U.S.C. 154(b) by 176 days.

(21) Appl. No.: 13/091,640

(22) Filed: Apr. 21, 2011

(65) Prior Publication Data

US 2011/0261570 A1 Oct. 27, 2011

(30) Foreign Application Priority Data

Apr. 22, 2010 (JP) ..... 2010-098349

(51) Int. Cl.
*F21V 3/00* (2006.01)
*F21V 5/00* (2006.01)
*F21V 7/00* (2006.01)

(52) U.S. Cl.
USPC ..... 362/311.06; 362/307

(58) Field of Classification Search
USPC ..... 313/110, 113, 114, 116; 385/146; 359/726; 362/307, 311.06, 311.01, 362/257, 310, 311.02, 311.12, 311.1
See application file for complete search history.

(56) References Cited

U.S. PATENT DOCUMENTS

2005/0111235 A1* 5/2005 Suzuki et al. ..... 362/555
2007/0030688 A1 2/2007 Amano et al.

FOREIGN PATENT DOCUMENTS

JP 2005-327649 A 11/2005
JP 2007-48470 A 2/2007
JP 2008-186742 A 8/2008
JP 4290601 B2 7/2009
JP 2009-244316 A 10/2009
WO W099/09349 A1 2/1999

OTHER PUBLICATIONS

Notification of Reason for Refusal from Japanese Patent App. No. 2010-098349 (Dec. 17, 2013) with English language translation thereof.

* cited by examiner

*Primary Examiner* — Britt D Hanley
*Assistant Examiner* — Zachary J Snyder
(74) *Attorney, Agent, or Firm* — Kenealy Vaidya LLP

(57) ABSTRACT

A light fixture unit can include a light source having an optical axis and a light guide body. The light guide body can include a light incident portion at a front of the light source protruding from a first surface, a light exit portion formed to be elongated in a first direction on a second surface, and a light guide portion. The light incident unit can be configured to make light enter into the light guide body while converting the light into parallel light in a second direction. The light guide portion can include second reflection surfaces disposed to provide a recess on the second surface, each of which is inclined at 45 degrees with respect to the optical axis outward in the first direction individually, and third reflection surfaces which make light reflected internally on the second reflection surfaces in the first direction reflected internally in the second direction toward the light exit portion.

3 Claims, 5 Drawing Sheets

LIGHTING FIXTURE UNIT

This application claims the priority benefit under 35 U.S.C. §119 of Japanese Patent Application No. 2010-098349 filed on Apr. 22, 2010, which is hereby incorporated in its entirety by reference.

BACKGROUND

1. Field

The presently disclosed subject matter relates to a lighting fixture unit.

2. Description of Related Art

As a lighting fixture unit to be used as a vehicle signal light or an agricultural light, a lighting fixture unit which emits light forward in a linear shape, as shown in Japanese Patent Application Laid-open Publication No. 2007-48470 (Patent Document 1) or Japanese Patent No. 4290601 (Patent Document 2), has been conventionally known.

A light fixture unit 800 of Patent Document 1 is equipped with: a light source 801 having a light intensity distribution in which light is dispersed in a right and left direction; an inner lens 802 which is elongated in the right and left direction and disposed at the front of the light source 801; and an outer lens 803, as shown in FIG. 5A. The light fixture unit 800 converts the right-left-direction dispersed light emitted from the light source 801 into parallel light along an optical axis of the light source 801 by the inner lens 802, and then diffuses the light by the outer lens 803 so that the outer lens 803 emits the light in a linear shape.

A light fixture unit 900 of Patent Document 2 is equipped with a light source 901 such as an LED, and a light guide body 902 which is elongated in the right and left direction and disposed at the front of the light source 901, as shown in FIG. 5B. The light guide body 902 includes a left-right pair of first reflection surfaces 902A, 902A which constitutes a form of paraboloid of revolution whose focal point is the light source 901 at a central region in a front surface of the light guide body 902. On both outsides of the first reflection surfaces 902A, 902A, output surfaces 902B, 902B each elongated in the right direction or in the left direction are formed. On the opposite side surfaces with respect to the output surfaces 902B, 902B, a plurality of second reflection surfaces 902C, . . . are formed. The light which is emitted from the light source 901 and enters into the light guide body 902 is reflected on the pair of first reflection surfaces 902A, 902A in the right direction or in the left direction, further reflected on the second reflection surfaces 902C, . . . forward, and diffused and emitted from the output surfaces 902B, 902B so that the output surfaces 902B, 902B emit light in a linear shape.

However, in the case of the light fixture unit 800 of Patent Document 1, the special light source 801 having the light intensity distribution in which light is dispersed in a right and left direction, and the two lenses (light guide bodies) of the inner lens 802 and the outer lens 803 are required. As a result, high costs are required.

Meanwhile, in the case of the light fixture unit 900 of Patent Document 2, though the special light source or two light guide bodies are not necessary, there is a problem that the first reflection surfaces 902A, 902A which do not emit light (emits no light) have large sizes in the right and left direction because the light emitted radially from the light source 901 enters directly into the light guide body 902 and then is reflected on the first reflection surfaces 902A, 902A having the form of paraboloid of revolution. As a result, a dark portion at a central region of the light fixture unit 900 becomes large when being seen from the front, and the light has difficulty in being recognized as having a linear shape.

SUMMARY

According to an aspect of the presently disclosed subject matter a lighting fixture unit can be configured to emit light in a precise linear shape at a low cost compared with a conventional lighting fixture unit.

According to another aspect of the disclosed subject matter, there is provided a light fixture unit that can include:

a light source which has an optical axis extends forward; and a light guide body including a light incident portion which is disposed at a front of the light source so as to extend in a first direction perpendicular to the optical axis and provided to protrude from a first surface toward the light source so as to face the light source, a light exit portion which is formed to be elongated in the first direction on a second surface which is an opposite surface with respect to the first surface, and a light guide portion which guides light from the light incident portion to the light exit portion, wherein the light incident unit makes light emitted from the light source enter into the light guide body while converting the light into parallel light in a second direction along the optical axis, and the light guide portion includes a pair of second reflection surfaces which are disposed to provide a recess on the second surface so as to be located in the second direction with respect to the light incident portion, each of which second reflection surfaces is inclined at 45 degrees with respect to the optical axis outward in the first direction individually, and a plurality of third reflection surfaces which make light reflected internally on the pair of second reflection surfaces in the first direction reflected internally in the second direction toward the light exit portion.

BRIEF DESCRIPTION OF THE DRAWINGS

The above and other advantages and features of the presently disclosed subject matter will become more fully understood from the detailed description given hereinbelow and the appended drawings which are given by way of illustration only, and thus are not intended as a definition of the limits of the presently disclosed subject matter, and wherein.

DETAILED DESCRIPTION OF EXEMPLARY EMBODIMENTS

In the following, an embodiment of the presently disclosed subject matter will be described with reference to the drawings. In this regard, however, the scope of the presently disclosed subject matter is not limited to the following embodiment and illustrated examples.

<Configuration of Light Fixture Unit>

Figure 1:
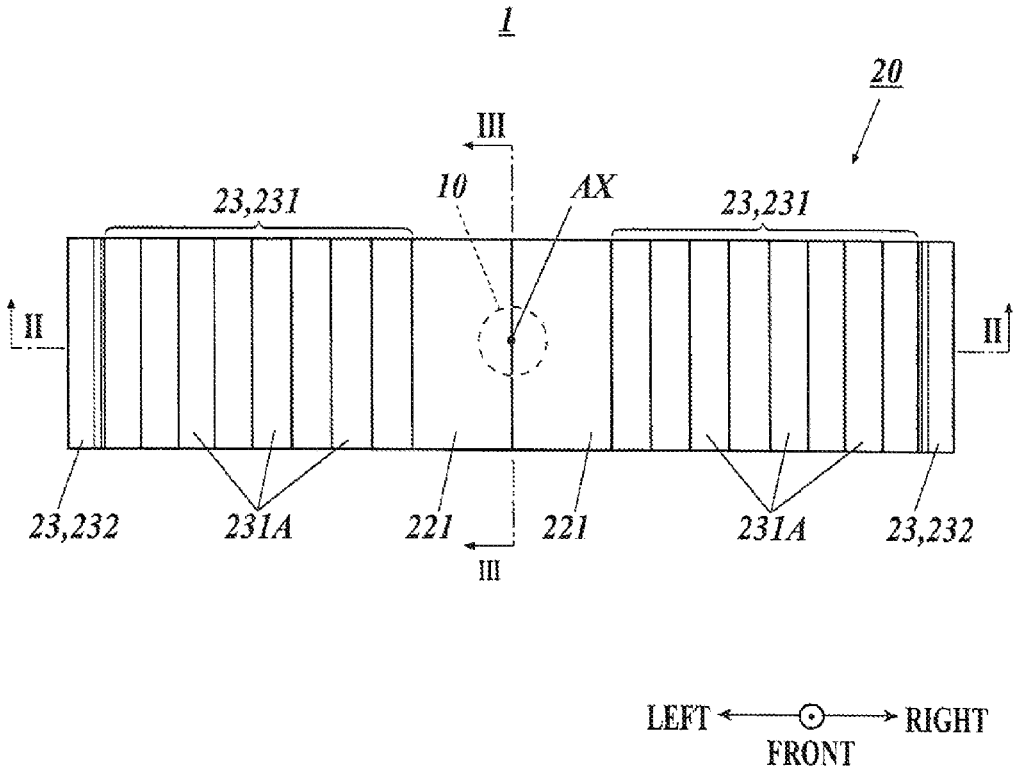
FIG. 1 is a front view showing a light fixture unit according to an embodiment.
Figure 2A:
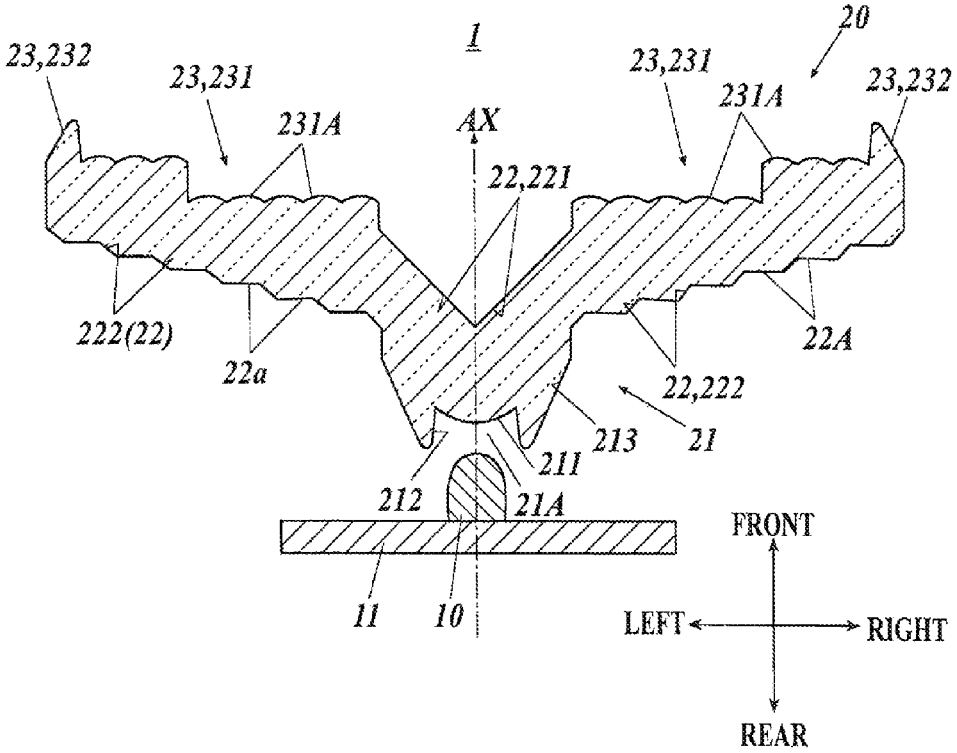
FIG. 2A is a cross-section view of FIG. 1 along line II-II.
Figure 2B:
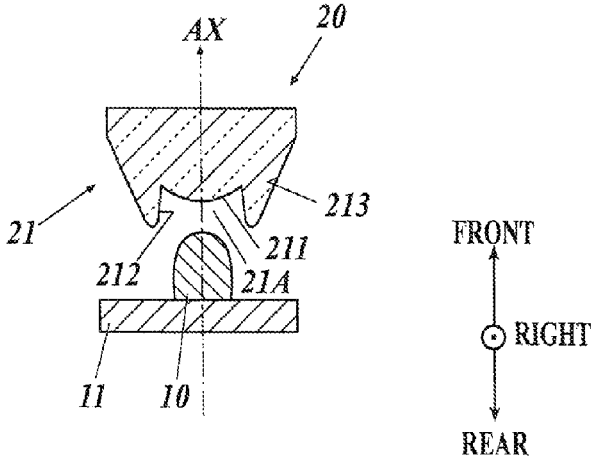
FIG. 2B is a cross-section view of FIG. 1 along line III-III.

FIG. 1 is a front view showing a light fixture unit according to an embodiment, FIG. 2A is a cross-section view of FIG. 1 along line II-II, and FIG. 2A is a cross-section view of FIG. 1 along line III-III.

As illustrated in these drawings, a light fixture unit 1 is equipped with a light source 10, and a light guide body 20 which is disposed at the front of the light source 10. The light fixture unit 1 is housed in a not-shown light chamber which is composed of a housing and a translucent cover.

The light source 10 includes an illuminant such as a light emitting diode, and is mounted on a substrate 11. The light source 10 has an optical axis AX extends forward, and emits light forward with a central focus on the optical axis AX.

The light guide body 20 makes light, which is emitted from the light source 10, emitted in a linear shape. The light guide body 20 is formed to be elongated so as to extend in a right and left direction perpendicular to the optical axis AX. In the embodiment, the light guide body 20 is formed to be symmetrical with a central focus on the optical axis AX.

Specifically, the light guide body 20 includes: a light incident portion 21 which makes the light emitted from the light source 10 enter into the light guide body 20; a light exit portion 23 which makes the light exit from the light guide body 20; and a light guide portion 22 which introduces the light from the light incident portion 21 to the light exit portion 23.

Among them, the light incident portion 21 is provided to protrude from a rear surface (a surface toward the light source 10) of the light guide body 20 so as to face the light source 10. More concretely, the light incident portion 21 is formed in a truncated conial shape whose rotation axis of symmetry is the optical axis AX. In a head portion of the light incident portion 21A recess portion 21A which opens rearward is formed.

On a bottom of the recess portion 21A, a first light incident surface 211 which is convex surface (aspheric surface) bulging rearward is formed so as to face the light source 10 around the optical axis AX as the rotation axis of symmetry. The first light incident surface 211 is disposed so that the light source 10 is located at a focal point of the first light incident surface 211. The first light incident surface 211 makes the light emitted from the light source 10 enter into the light guide body 20 while refracting the light in a direction (hereinafter referred to as optical axis AX direction) along the optical axis AX.

An inner periphery surface of the recess portion 21A, which is arranged in an outer edge of the first light incident surface 211, constitutes a second light incident surface 212. The second light incident surface 212 is a conical surface provided to stand rearward so as to surround the light source 10, and makes the light which travels more sideways than the first light incident surface 211 among the light emitted from the light source 10 enter into the light guide body 20.

An outer periphery surface of the light incident portion 21 becomes a first reflection surface 213. The first reflection surface 213 makes the light entering from the second light incident surface 212 into the light guide body 20 reflected internally in the optical axis AX direction.

The light guide portion 22 includes a left-right pair of second reflection surfaces 221, 221 which is formed on a front surface of the light guide body 20, and a plurality of third reflection surfaces 222, . . . which are formed on a rear surface of the light guide body 20.

The pair of second reflection surfaces 221, 221 is disposed to provide a recess on the front surface of the light guide body 20 so as to be located in the optical axis AX direction with respect to the light incident portion 21. Specifically, the pair of second reflection surfaces 221, 221 constitutes a dogleg shape whose folding point is the optical axis AX direction from a lateral view. Each of the second reflection surfaces 221, 221 is inclined at 45 degrees with respect to the optical axis AX in the right direction or in the left direction individually. The second reflection surfaces 221, 221 make the light travelling in the optical axis AX direction through the first light incident surface 211 and the first reflection surface 213 reflected internally while branching the light from the optical axis AX in the right direction and in the left direction.

Meanwhile, the plurality of third reflection surfaces 222, . . . are formed in each of the right and left portions on the rear surface of the light guide body 20. Each of the right and left portions of the rear surface is formed in a staircase pattern. Each of step surfaces 22A is perpendicular to the optical axis AX. The step surfaces 22A are located more forward, in a step-by-step manner, as they get away from the optical axis AX. Each of the third reflection surfaces 222, . . . is continued to the step surfaces 22A in the right direction and in the left direction alternately to constitute stair-like surfaces, and formed to be parallel to one of the pair of second reflection surfaces 221, 221 which is closer to the each of the third reflection surfaces 222, . . . . The third reflection surfaces 222, . . . are located outer than the second reflection surfaces 221, 221 in the right direction and in the left direction, and each of the third reflection surfaces 222, . . . makes the light, which is internally reflected on the second reflection surfaces 221, 221 and branched in the left direction and the right direction, reflected internally in the optical axis AX direction.

The light exit portions 23, 23 are disposed at the sides of the second reflection surfaces 221, 221 on the front surface of the light guide body 20 so as to be located in the optical axis AX direction with respect to the third reflection surfaces 222, . . . . Each of the light exit portions 23, 23 is formed to be elongated in the right direction or in the left direction. Each of the light exit portions 23, 23 includes a first light exit surface 231 elongated in the right and left direction and a second light exit surface 232 at a side end of the each of the light exit portions 23, 23.

The first light exit surface 231 is configured by arranging cylindrical surfaces 231A in a line in the right and left direction, each of the cylindrical surfaces 231A having a generatrix in a thickness direction (in a vertical direction in FIG. 1) of the light guide body 20 and bulging forward. The first light exit surface 231 diffuses the light which is internally reflected on the third reflection surfaces 222, . . . to output the light from the light guide body 20.

Meanwhile, the second light exit surface 232 is formed at each side end on the front surface of the light guide body 20. The second light exit surface 232 is an inclined surface which faces diagonally forward and is formed in a projecting portion at a front surface end of the light guide body 20. The second light exit surface 232 makes the light, which is internally reflected on the third reflection surfaces 222 at right end or at left end, emitted in diagonally forward right direction or in diagonally forward left direction.

Figure 3:
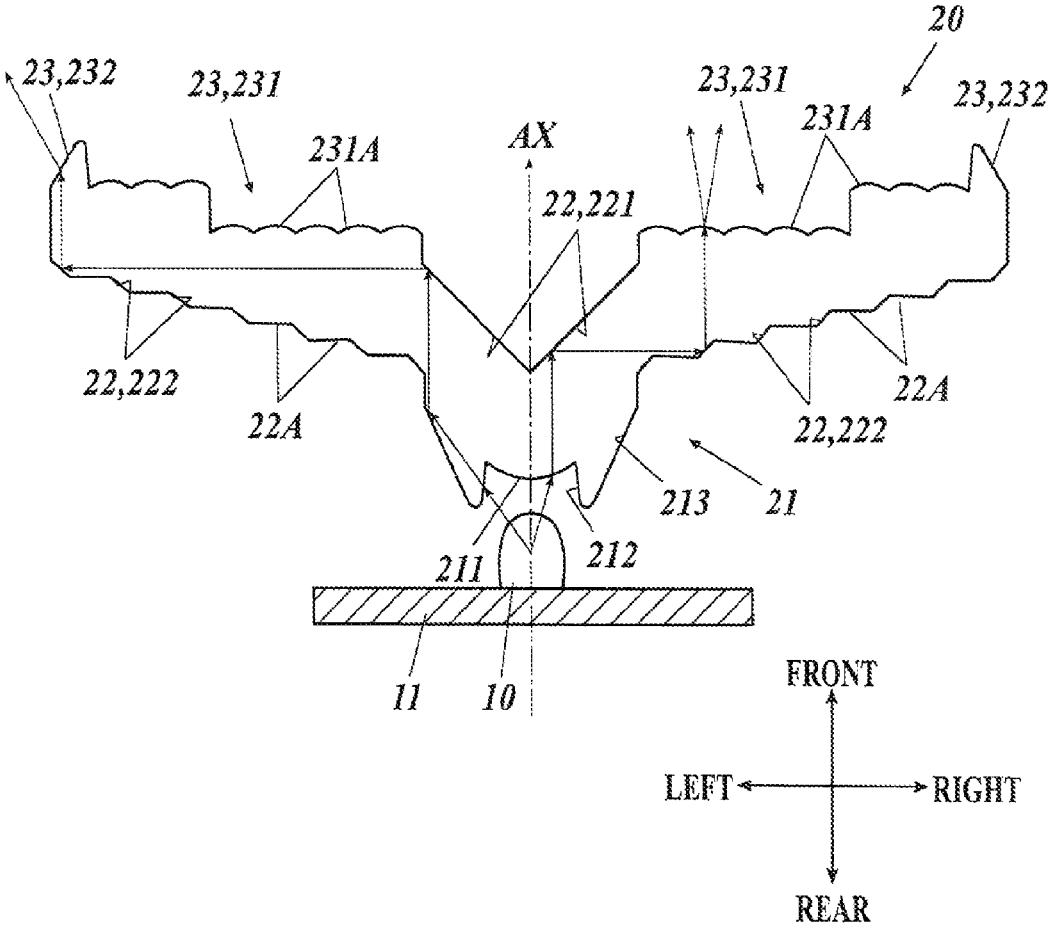
FIG. 3 is a view for explaining optical paths in the light fixture unit.

According to the light guide body 20 of the above configuration, as shown in FIG. 3, the light emitted from the light source 10 to the first light incident surface 211 is refracted by the first light incident surface 211 in the optical axis AX direction and enters into the light guide body 20, and the light emitted more sideways than the first light incident surface 211 enters from the second light incident surface 212 into the light guide body 20 and then internally reflected on the first reflection surface 213 in the optical axis AX direction. In other words, the light emitted from the light source 10 is converted into the parallel light along the optical axis AX direction by the light incident portion 21 and enters into the light guide body 20. These parallel lights travelling in the light guide body 20 in the optical axis AX direction are internally reflected while being branched from the optical axis AX in the right direction and in the left direction by the pair of the second reflection surfaces 221, 221, and dispersed in the right direction and in the left direction by the third reflection surfaces 222, . . . , which are intermittently distribute in the right and left direction, while each being internally reflected in the optical axis AX direction. After that, the lights internally reflected on the third reflection surfaces 222, . . . are diffused and exited forward from the first light exit surfaces 231, 231, and are exited in diagonally forward right direction and in diagonally forward left direction from the second light exit surfaces 232, 232. Thus, the light exit portions 23, 23 each of which is composed of the first light exit surface 231 and the second light exit surface 232 and is elongated in the right and left direction emit the light in the linear shape, between which the pair of second reflection surfaces 221, 221 are disposed.

<Operations and Effects>

According to the abovementioned light fixture unit 1, since the light entering into the light guide body 20 is converted into the parallel light along the optical axis AX direction and then the parallel light is branched in the right direction and in the left direction by the pair of second reflection surfaces 221, 221 each making the angle of 45 degrees with respect to the optical axis AX, the pair of second reflection surfaces 221, 221 which may become the dark portion can be shortened in the right and left direction, compared with the conventional light fixture unit in which the pair of second reflection surfaces 221, 221 is formed to constitute the form of paraboloid of revolution. Moreover, because the generally-used light source 10 and one light guide body 20 are enough, the light fixture unit 1 can be constituted at low cost compared with the conventional light fixture unit requiring the special light source and the two of the light guide bodies.

Therefore, compared with the conventional technique, the present embodiment enables emitting the light in a precise linear shape at low cost.

Moreover, since by using the second light incident surface 212 and the first reflection surface 213 even the light emitted more sideways than the first light incident surface 211 can enter into the light guide unit 20 and be converted into the parallel light along the optical axis AX direction, more light can be taken to be used compared with the case of using only the first light incident surface 211. As a result, a light flux utilization ratio is improved so that the light exit portion 23 can emit the light more precisely.

Furthermore, since each of the pair of second reflection surfaces 221, 221 is a plain surface making the 45 degrees with respect to the optical axis AX, the recess in the front surface of the light guide body 20 constituted by the pair of the second reflection surfaces 221, 221 can be downsized compared with the conventional light fixture unit in which the pair of second reflection surfaces 221, 221 is formed to constitute the form of paraboloid of revolution, and thereby the light fixture unit 1 gets good-looking.

<Variation>

The embodiments to which the presently disclosed subject matter can be applied are not limited to the above, and can be changed arbitrary without departing from the principles of the presently disclosed subject matter.

Figure 4:
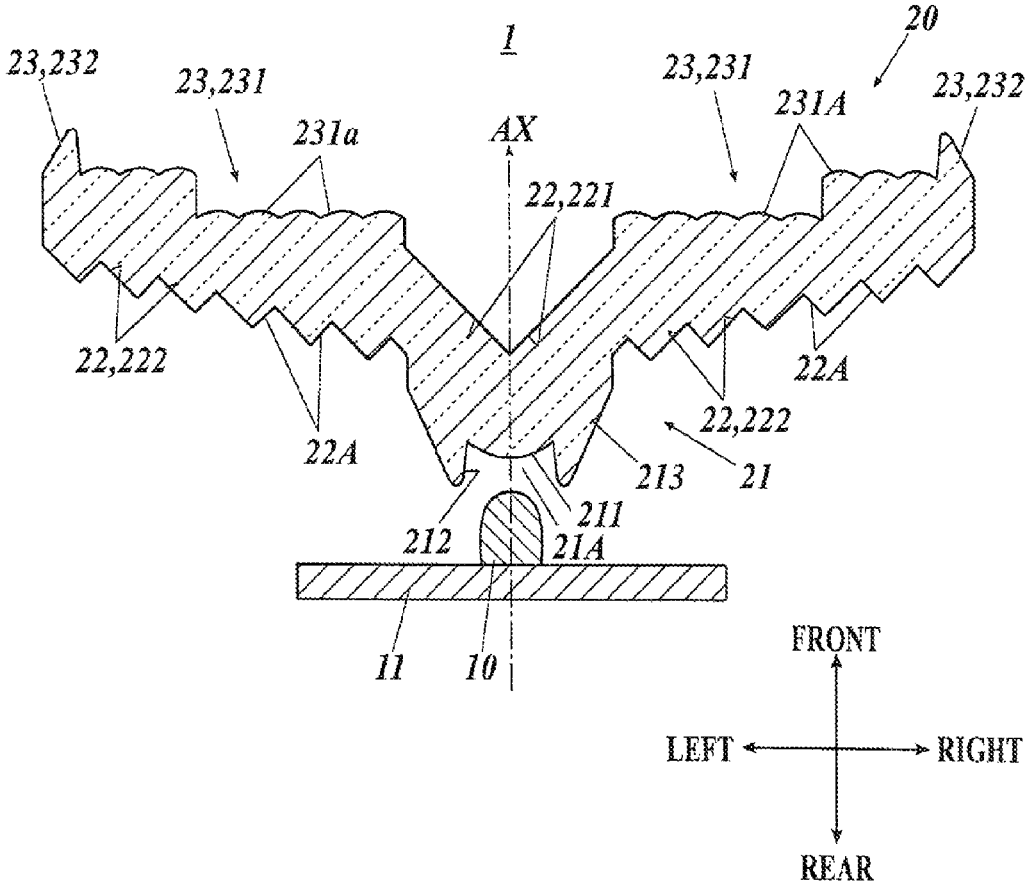
FIG. 4 is a cross-section view of an another example of the light fixture unit.
Figure 5A:
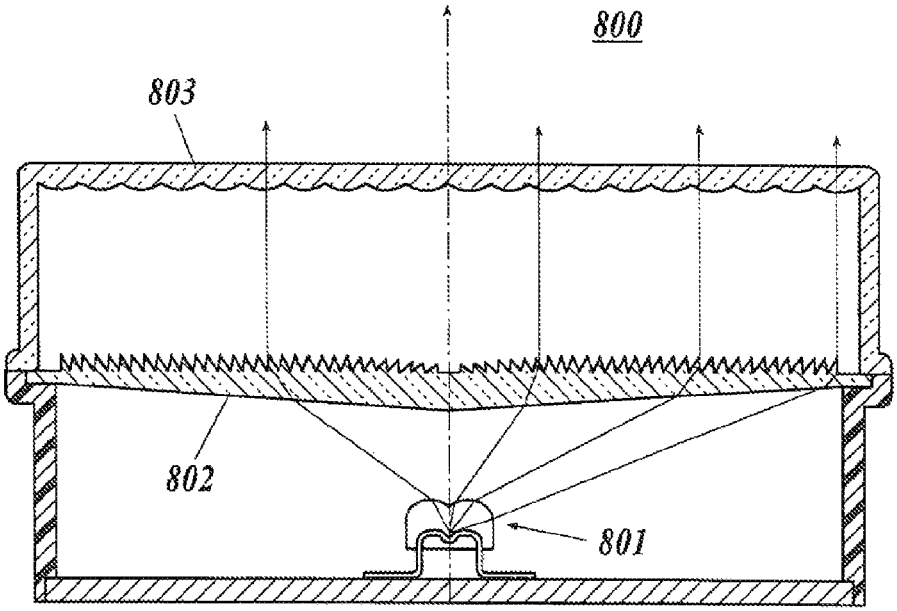
FIG. 5A is a view for explaining a conventional light fixture unit.
Figure 5B:
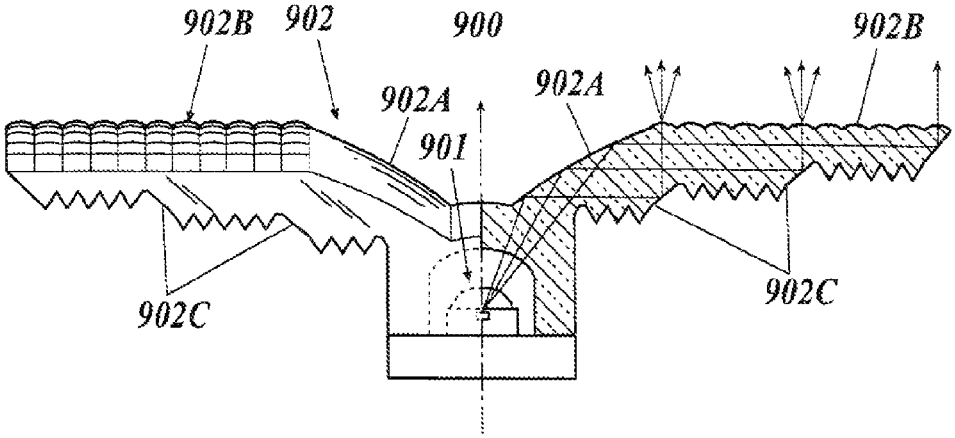
FIG. 5B is a view for explaining a conventional light fixture unit.

For example, though the right and left portions on the rear surface of the light guide unit 20 are formed in the staircase pattern where each of the step surfaces 22A is perpendicular to the optical axis AX, as shown in FIG. 4, the right and left portions can be saw-toothed where each of the step surfaces 22A is perpendicular to the third reflection surface 222. In this regard, however, each of the step surfaces 22A can be perpendicular to the optical axis AX, because the step surfaces 22A make stray light inside the light guide unit 20 reflected thereon toward the light exit portion 23 so that the light exit portion 23 can emit the light more strongly.

Moreover, though the pair of second reflection surfaces 221, 221 branch the light from the optical axis AX in the right direction and in the left direction, the branch point is not limited to the optical axis AX as long as the light is branched in the right direction and in the left direction.

Furthermore, though the light fixture unit 1 is composed of a set of the light source 10 and the light guide unit 20, a plurality sets of the light sources 10 and the light guide units 20 can be connected to each other in the right and left direction so that further elongated light in the linear shape is emitted.

According to the embodiment, a light fixture unit can include:

a light source which has an optical axis extends forward; and a light guide body including a light incident portion which is disposed at a front of the light source so as to extend in a first direction perpendicular to the optical axis and provided to protrude from a first surface toward the light source so as to face the light source, a light exit portion which is formed to be elongated in the first direction on a second surface which is an opposite surface with respect to the first surface, and a light guide portion which guides light from the light incident portion to the light exit portion, wherein the light incident unit makes light emitted from the light source enter into the light guide body while converting the light into parallel light in a second direction along the optical axis, and the light guide portion includes a pair of second reflection surfaces which are disposed to provide a recess on the second surface so as to be located in the second direction with respect to the light incident portion, each of which second reflection surfaces is inclined at 45 degrees with respect to the optical axis outward in the first direction individually, and a plurality of third reflection surfaces which make light reflected internally on the pair of second reflection surfaces in the first direction reflected internally in the second direction toward the light exit portion.

The light incident portion can include a first light incident surface which is formed to be a convex surface facing the light source and makes the light emitted from the light source enter into the light guide body while refracting the light in the second direction, a second light incident surface which is provided to stand toward the light source in an outer edge of the first light incident surface and makes light emitted from the light source and traveling more sideways than the first light incident surface enter into the light guide unit, and a first light reflection surface which constitutes an outer periphery surface of the light incident portion and makes light entering from the second light incident surface into the light guide body reflected internally in the second direction.

The plurality of third reflection surfaces can be located outer than the pair of second reflection surfaces in the first direction and disposed on the first surface so that the light exit portion is located in the second direction with respect to the third reflection surfaces, and each of the third reflection surfaces is formed to be parallel to one of the pair of second reflection surfaces.

The light guide body can be formed to be symmetrical in the first direction with a central focus on the optical axis.

The light emitted from the light source enters into the light guide body while being converted into the parallel light in the optical axis direction by the light incident portion, is internally reflected on the pair of second reflection surfaces while being branched in both of right and left directions (in a direction perpendicular to the optical axis), and then is internally reflected on the third reflection surfaces in the light axis direction to be emitted from the light exit portion. By this, the light exit portions each elongated in the right and left direction, between which the pair of second reflection surfaces are disposed, emit the light in the linear shape.

Thus, since the light entering into the light guide body is converted into the parallel light along the optical axis direction and then the parallel light is branched in both of right and left directions (in the direction perpendicular to the optical axis) by the pair of second reflection surfaces each making the angle of 45 degrees with respect to the optical axis, the pair of second reflection surfaces which may become the dark portion can be shortened in the direction perpendicular to the optical axis, compared with the conventional light fixture unit in which the pair of second reflection surfaces (the first reflection surface of Patent Document 1) is formed to constitute the form of paraboloid of revolution. Moreover, because the generally-used light source and one light guide body are enough, the light fixture unit of the presently disclosed embodiment can be constituted at low cost compared with the conventional light fixture unit requiring the special light source and the two of the light guide bodies.

Therefore, compared with the conventional technique, the presently disclosed embodiment enables emitting light in a precise linear shape at low cost.

The light emitted from the light source to the first light incident surface enters into the light guide body while being refracted in the light axis direction by the first light incident surface, and the light emitted more sideways than the first light incident surface enters into the light guide body from the second light incident surface and then internally reflected on the first reflection surface in the light axis direction. Thus, since even the light emitted more sideways than the first light incident surface enters into the light guide unit and is converted into the parallel light along the optical axis direction, more light can be taken to be used compared with the case of using only the first light incident surface. As a result, a light flux utilization ratio is improved so that the light exit portion can emit the light more precisely.

The entire disclosure of Japanese Patent Application No. 2010-098349 filed on 22 Apr. 2010 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow and their equivalents.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. A light fixture unit comprising:

a light source which has an optical axis extending forward; and a light guide body including a light incident portion which is disposed at a front of the light source so as to extend in a first direction perpendicular to the optical axis and provided to protrude from a first surface toward the light source so as to face the light source, a light exit portion which is formed to be elongated in the first direction on a second surface which is an opposite surface with respect to the first surface, and a light guide portion which guides light from the light incident portion to the light exit portion, wherein the light incident portion is configured to make light emitted from the light source enter into the light guide body while converting the light into parallel light in a second direction along the optical axis, wherein the light incident portion includes a first light incident surface which is formed to be a convex surface facing the light source and is configured to make the light emitted from the light source enter into the light guide body while refracting the light in the second direction, a second light incident surface which is provided to stand toward the light source in an outer edge of the first light incident surface and is configured to make light emitted from the light source and traveling more sideways than the first light incident surface enter into the light guide unit, and a first reflection surface which constitutes an outer periphery surface of the light incident portion and is configured to make light entering from the second light incident surface into the light guide body reflected internally in the second direction, and wherein the light guide portion includes a pair of second reflection surfaces which are disposed to provide a recess on the second surface so as to be located in the second direction with respect to the light incident portion, each of which second reflection surfaces is inclined at 45 degrees with respect to the optical axis outward in the first direction individually, and a plurality of third reflection surfaces which are configured to make light reflected internally on the pair of second reflection surfaces in the first direction reflected internally in the second direction toward the light exit portion.

2. The light fixture unit according to claim 1, wherein the plurality of third reflection surfaces are located in a more outward location than the pair of second reflection surfaces in the first direction and disposed on the first surface so that the light exit portion is located in the second direction with respect to the third reflection surfaces, and each of the third reflection surfaces is formed to be parallel to one of the pair of second reflection surfaces.

3. The light fixture unit according to claim 1, wherein the light guide body is formed to be symmetrical in the first direction with a central focus on the optical axis.

* * * * *